United States Patent [19]

Forrester et al.

[11] Patent Number: 4,769,637

[45] Date of Patent: Sep. 6, 1988

[54] VIDEO DISPLAY CONTROL CIRCUIT ARRANGEMENT

[75] Inventors: Ned C. Forrester, East Falmouth; Robert C. Rose, Hudson, both of Mass.; Thomas C. Furlong, Half Moon Bay, Calif.

[73] Assignee: Digital Equipment Corporation, Maynard, Mass.

[21] Appl. No.: 802,226

[22] Filed: Nov. 26, 1985

[51] Int. Cl.[4] ..... G09G 1/16

[52] U.S. Cl. ..... 340/726; 340/724; 340/748; 340/750

[58] Field of Search ..... 340/723, 724, 726, 748, 340/750, 798, 799

[56] References Cited

U.S. PATENT DOCUMENTS

| | | | |
|---|---|---|---|
| 4,196,430 | 4/1980 | Denko | 340/726 |
| 4,412,294 | 10/1983 | Watts et al. | 340/726 |
| 4,437,093 | 3/1984 | Bradley | 340/726 |
| 4,602,251 | 7/1986 | Sawada et al. | 340/750 |
| 4,611,202 | 9/1986 | DiNitto et al. | 340/724 |
| 4,642,794 | 2/1987 | Lavelle et al. | 340/726 |
| 4,649,379 | 3/1987 | Canton et al. | 340/748 |

FOREIGN PATENT DOCUMENTS 0059349 9/1982 European Pat. Off. .

*Primary Examiner*—Gerald L. Brigance
*Attorney, Agent, or Firm*—Michael N. Meller

[57] ABSTRACT

The present circuit arrangement is principally directed to scrolling of a region or regions on a video display and includes a bit map memory, at least one address generation and control signal circuitry chip, one or more data signal path circuitry chips, timing circuitry and logic circuitry interconnecting the foregoing various sections of circuitry. The present arrangement functions to refresh, scroll and update during each horizontal scan, in response to a plurality of timing cycles, with every other cycle being a refresh cycle and the intervening cycles being either scroll or update cycles. During a refresh cycle there is a burst of signals read from memory and transmitted to a shift register feeding the video screen to effect refreshing a section of the screen. At the same time those signals are used to refresh the memory. During the alternate cycles (between refresh cycles) there may be a burst of signals from the signal path circuitry chip to write information into the bit map memory at some new address to effect scrolling. Instead of performing scrolling in the alternate cycles, information may be erased from a region. In the alternative there may be a burst of signals from an information source transmitted to the bit map memory to effect updating (i.e. writing new data information into the memory). The foregoing arrangement permits the entire bit map memory to be rewritten during the period required for one vertical scan of the video display device which in turn enables the system to provide rapid smooth scrolling and continued sequential addressing of the memory.

17 Claims, 5 Drawing Sheets

VIDEO DISPLAY CONTROL CIRCUIT ARRANGEMENT

BACKGROUND

The present circuit arrangement is directed to providing scrolling including both vertical scrolling and horizontal scrolling. As mentioned above we are discussing scrolling of a region and not an entire screen movement of visual data. In the prior art, scrolling has been accomplished by refreshing the scroll region together with other regions from the memory through a random access procedure and directing the information read from the memory to the screen. In this prior art arrangement sequential addressing of the memory is disrupted and because of such disruption such a system lacks flexibility in respect to defining the boundaries of scrolling. In some other arrangements data is copied from the memory through a device such as a DMA (Direct Memory Access) and returned to memory. A problem with such a system is that the rewrite consumes a relatively great amount of time (i.e., more than one vertical scan time), and the resulting scrolling procedure is normally not considered smooth. The present system operates at high speed and employs a technique which enables the bit map memory to be completely rewritten within one vertical scan. The system operates to display one pattern during a vertical scan while the memory is actually being reconfigured to another pattern. The memory is ready at the end of a vertical scan to be sequentially scanned a second time to display a different pattern and all of the changes required to display that different pattern have been made in the memory per se and not in some temporary storage device. The ability of the present system to reconfigure the memory within one vertical scan time is advantageous with respect to refreshing the memory. The techniques and hardware to refresh a bit map memory are well understood. In a system that addresses a bit map memory sequentially for screen refresh, the bit map memory is automatically refreshed one row at a time through registers. However, in a system that employs a random access of the bit map memory, special hardware is employed to refresh the memory. The present system is able to continually sequentially address the memory and hence does not require special hardware to refresh.

SUMMARY

The present circuit is designed to enable a control circuit chip to route information signals from the bit map memory to refresh a video screen. At the same time the control chip is able to direct such information signals, or portions thereof, to a temporary storage means wherefrom they are rewritten at selected, or new, addresses. In addition, the control chip can direct new information signals to be written into the memory when rewriting from temporary storage is not required. After completion of a vertical scan, the memory stands rewritten and possibly with some new information. Because the memory is ready to be displayed with its rewritten and/or new information, the system during the subsequent vertical scan addresses the bit map memory in a normal fashion, i.e. sequentially. In the event information signals have been rewritten into selected new addresses, the system is able to provide an informational display on the video screen that will cause the viewer to see a scroll region "moving up" and alternatively "moving down," smoothly. In addition, the scroll region can be "moved" to the left or the right. To accomplish the foregoing, the present system employs a plurality of data path chips working with one control chip circuit. It should be understood that the system employs one data path chip for each plane so that if there are multiple planes, such as in a color system, then there would be multiple data path chips assigned to one control chip. The data path chips each include two output registers as well as an input FIFO register and a barrel shifter. Each of the two registers, in a preferred embodiment, accepts and temporarily stores bursts of 128 bits which come through the FIFO and through the barrel shifter from the bit map memory. The bursts are transmitted during every other cycle of a plurality of cycles which occur during a single horizontal scan time. A barrel shifter is employed (during a horizontal scroll mode) to effect shifting of the information before it is loaded into either of the two output registers so that the horizontal scroll, can be accomplished. The information first entering the data path chip is accepted by the input FIFO register and then is transferred through the barrel shifter to the output register devices. The timing circuitry which is employed with the present system provides a plurality of cycles during each horizontal scan. The cycles are arranged so that every other cycle, is a refresh cycle during which time both the screen and the memory are refreshed. The intermediate cycles are either scroll cycles or update cycles. The term "scroll cycle" refers to the time period during which information signals (which were read during the refresh cycle) are rewritten back into the memory at new addresses. The term "update cycles" refers to time periods during which information is read and/or written, to add new data to the memory. A bit map memory of 850K pixels, as can be employed in the preferred embodiment, can be refreshed to the screen every 16.6 milliseconds. In the present system by refreshing the bit map memory simultaneously with refreshing the screen, the bit map memory is refreshed every 0.5 millisecond. Accordingly during a vertical scan, 40% of the time is used to refresh the screen, 40% of the time is used to do scroll or update and a remaining 20% is always left in which to update. In accordance with this arrangement, any part of the visible bit map memory can be completely copied within the time period of one vertical scan and this enables the system to have advantages over prior art systems. As mentioned earlier, since the entire visible bit map memory can be rewritten within one vertical scan, it enables the system to provide smooth scrolling at high speeds. In addition, by being able to make all of the necessary changes in the memory per se during a vertical scan time, the system can maintain a sequential addressing mode which is advantageous.

The objects and features of the present invention will be better understood in conjunction with the following description taken with the drawings wherein:

FIGS 1A through 1F include three layouts of portions of a video screen and corresponding portions of the bit map memory during a vertical upward scroll:

FIGS. 2A though 2F include three layouts of portions of a video screen and corresponding portions of the bit map memory during a vertical downward scroll;

Figure 1:
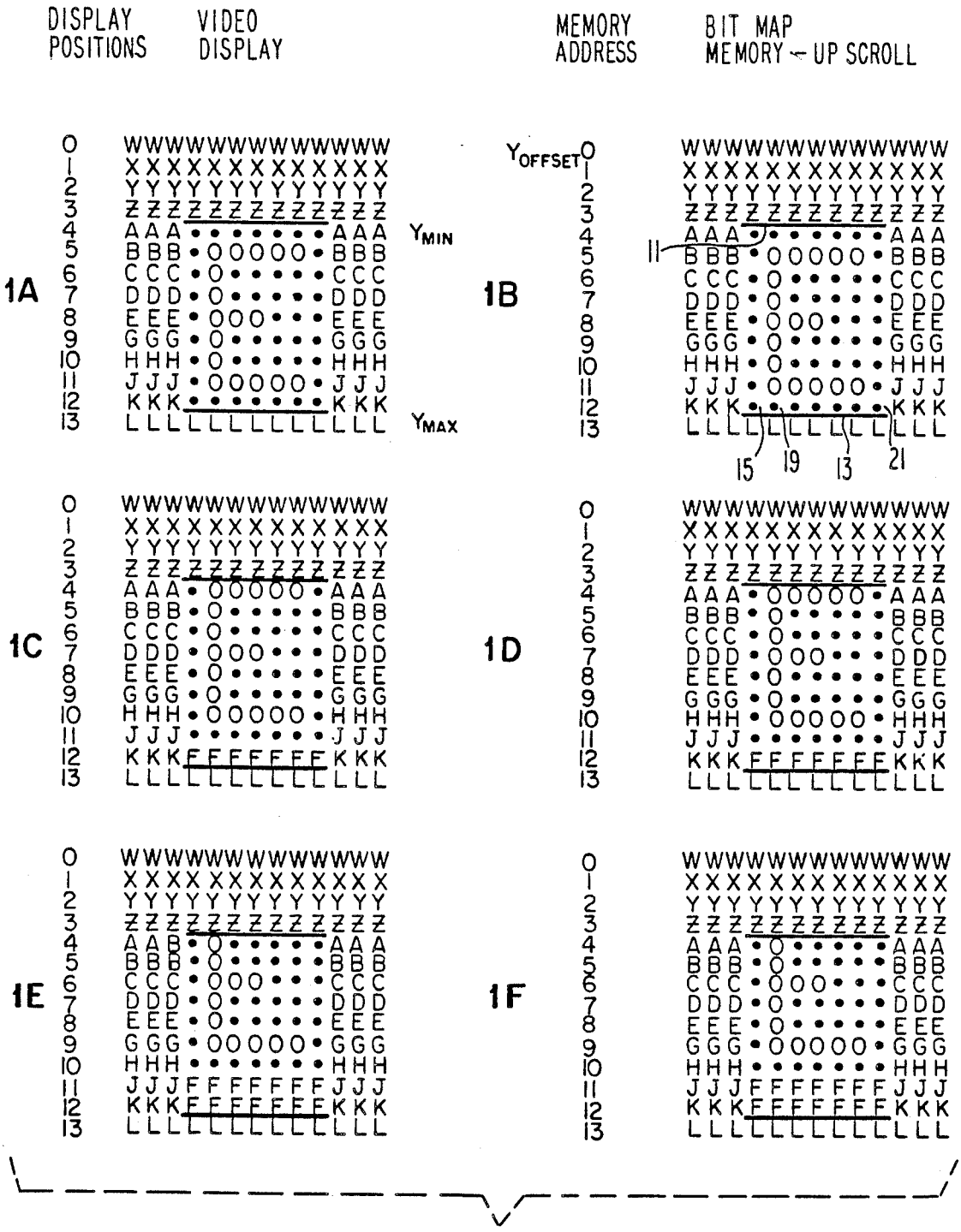
Figure 2:
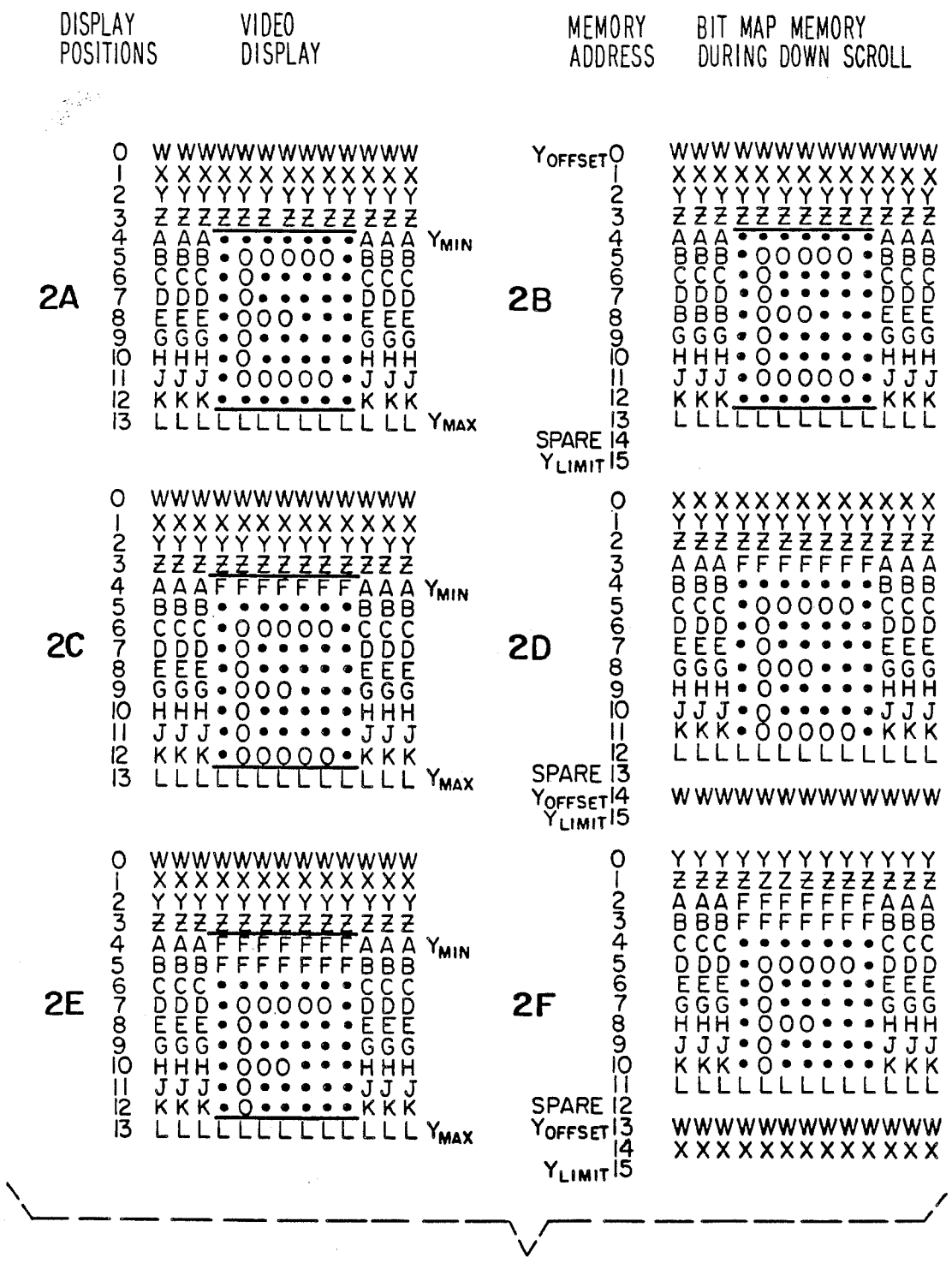

Each piece of information in the layouts of FIGS. 1 and 2 represents a pixel in a displayed pattern. One row of pixels, such as the row of "Ws", is scanned during one horizontal scan.

Consider FIG. 1 which is made up of illustrations FIG. 1A through the video display during upward scrolling FIG. 1B is an arrangement of pixels in a bit map memory at some point in time. Within the bit map memory there is a scroll region which is defined by the lines 11 and 13. Hereinafter the scroll region may be referred to as the region. The letters W, X, Y, Z, A, B, C, D, E, G, H, J, K, and L simply represent information, which lies outside of the scroll region and which would appear on the video screen, having been read from the bit map memory. Within the scroll region, it can be seen that there is a plurality of dots.and a plurality of circles. The circles form the letter E, while the dots represent a background, such as the color blue or the color yellow, to provide a basis for showing the letter E. In FIG. 1A, the information which appears on the screen is identical, to the information of FIG. 1B appearing in the bit map memory. Consider now that the system goes into a vertical, upward scrolling mode. During the first vertical scan of the upward scrolling operation, the information will be seen on the screen as shown in FIG. 1A, but during that same vertical scan the information will be rewritten into the bit map memory as shown in FIG. 1D. In the upward scrolling mode, the present system is designed such that the information in the bit map memory is read out for display on the video screen, and simultaneously therewith the information is read into a temporary storage means, from whence it may be rewritten back into the memory bit map, at different addresses than the addresses from which it was fetched. Such a procedure, i.e., writing back into another address in memory, defines the procedure to which we refer as scrolling. Scrolling takes place during the cycles between refresh cycles. In FIG. 1B, the row of information signals within the scroll region, lying along side of AAA, has a Y address of 4. As can be seen from FIG. 1D, during the scroll cycle the information in the region alongside AAA (FIG. 1B) was not rewritten back into the bit map memory. Accordingly, the uppermost row in the region disappears because it is not rewritten during a scroll cycle. In this upward scrolling mode the address of the top row of information signals of the scroll region is decremented by the value of one during each vertical scan. The addresses could be decremented by some other value to speed up the movement of the region. The information signals, such as the upper stroke of the letter E at address 5 in FIG. 1B, will have been rewritten during the first vertical scan into the bit map memory at the new address (i.e. at address 4 in FIG. 1D). During the next vertical scan the information in FIG. 1D is used to refresh the display on the screen and it is during that time that the display shows the region moving upward as depicted in FIG. 1C. It will be noted that in the display of FIG. 1C, the scroll region opposite AAA no longer has the series of dots that were found in FIG. 1A, but rather the upper stroke of the letter E is now opposite the outside information, AAA. Accordingly the viewer sees the letter E as moving in an upward scroll. Also the row positions within the scroll region lying opposite address 12 have had filler (F) information loaded therein. The filler information is background information such as a color and is supplied to the bit map memory during a scroll cycle. During the second vertical scan, the information from FIG. 1D is altered and the altered information is written back into the bit map memory in the format shown in FIG. 1F. The information opposite AAA is now the information that was at address 6 in FIG. 1B. The various other rows of information within the region are in new addresses as well. The pixels of the bit map memory at addresses 11 and 12, lying opposite JJJ and KKK, have been loaded with filler information (F) which was supplied thereto during a scroll cycle.

The change of the configuration of the bit map memory, from the format shown in FIG. 1B to the format shown in FIG. 1D, took place during the first vertical scan. During that first vertical scan the video screen appeared as shown in FIG. 1A even though the bit map memory was being altered. During the second vertical scan, when the bit map memory is being changed to appear as shown in FIG. 1F, the display on the screen will appear as shown in FIG. 1C. During the third vertical scan, the bit map memory will be changed from the format shown in FIG. 1F but the display will be shown as depicted in FIG. 1E. Note in FIG. 1E that the information along side of AAA, in the scroll region, is the second line circle position of the letter E which is now the top position in the scrolling region. Accordingly the viewer sees the letter E moving further upward in this scroll operation. The scroll operation continues in this fashion until the letter E has completely disappeared, if that is what the user wants to accomplish. As mentioned earlier, the filler information is placed in the bit map memory during a scroll cycle, instead of requiring the system to copy other data. The filler information prevents the user from seeing uncleared memory if the system does not fill with data by the next vertical scan. The system does provide the capability of replacing the background color with new data, as additional images, and this takes place during an update cycle.

FIGS. 2A–2F depict the states of the bit map memory and the video display during downward scrolling. It should be understood that in a downward scrolling operation with the present system, information in the bit map memory that surrounds the scroll region is moved upward. In other words, in a downward scroll operation the information which is external to the scroll region, for instance, the information AAA (FIG. 2B), would be moved from address 4 to address 3 during the first vertical scan. Such an operation involves copying every row of information outside of the scroll region and rewriting it into a new address, The information signals in the scroll region are not copied and rewritten. As the outside information is moved upward in memory, the pixel positions which lie between the outside information segments at the top of the scroll region (e.g. between AAA on the right and AAA on the left) are loaded with filler information. When the pixels of the row directly below the scroll region are copied, they replace the pixels of the lowest row in the scroll region. Hence the lowest row of the region continually disappears. The display procedure gives the illusion of the region being moved downward as shown in FIGS. 2A, 2C and 2E.

If the foregoing operation continued without any further refinements an enormous amount of spare, or unused, memory would have to be provided to accommodate all of the outside information which was being moved upward. This would be expensive and wasteful and accordingly the system provides other means of moving the outside information upward, i.e. the so-called wrap around arrangement.

Before discussing the details of the wrap-around arrangement, the concepts of Yoffset and Ylimit should be considered. The display region, which includes the scroll region, can start at any position within a block of memory reserved for the display region. Such a block of memory includes all of the memory from address zero through a limiting boundary, Ylimit. When the control portion of the system wants to provide the display on the video screens, it must start addressing the memory at the address whereat the display region begins. The beginning address is the Yoffset address, so called because the zero address of the display region is offset from the zero address of the memory by a predetermined number of rows. In other words, if the display region started at row 122 of the memory, then the zero row (or first row) of the display region would be at the 122 row of memory and the Yoffset for the display region would be 122. The control section of the system must know the number of rows in the display region. In the example set out in FIGS. 2A through 2F, there are 14 rows (i.e., row 0 through row 13). If the maximum scroll constant (i.e. Ysc) is one, that is, the system is to operate during each vertical scan to seemingly decrement the scroll region by one row, then one spare row is needed in memory for effecting a wrap around. The number of rows that the display is decremented (or incremented) is referred to as the scroll constant Ysc. If the maximum scroll constant were two, then two spare rows would be required. Given the foregoing premise, we need 15 rows of memory (i.e., 14 rows plus 1 spare row) are needed to accommodate the display region shown in FIGS. 2A through 2F. Accordingly the system does not use the 16th row and beyond and hence the Ylimit address is 15. When the system, is reading from memory and has counted 14 rows from Yoffset, it knows that no more information, during that vertical scan, is to be read from memory to effect the display. In FIG. 2B, it can be seen that memory address 15 (row 16) is Ylimit. The concepts of Yoffset and Ylimit are employed to effect the wrap-around procedure.

Assume that the bit map memory is in the format shown in FIG. 2B. Further assume that the system is going into a downward scroll operation. During the first vertical scan the screen will be refreshed as shown in FIG. 2A and the bit map memory will be scrolled, or rewritten, to assume the format shown in FIG. 2D. Note in FIG. 2D the row of Ws is now located in address 14 (the spare row of FIG. 2B) and the row of Xs is located in address zero. Further note that when the bit map memory was altered during the first vertical scan, filler material was added between the outside information AAA right as seen in FIG. 2D at address 3. Further note that in address 12 (where dots had previously resided in the scroll region of FIG. 2B) the Ls were copied so that the lower stroke of the letter E is now the lowermost image row in the scroll region. The row with the Ls is the row of outside information which lies directly below the lowest row of the scroll region during each vertical scan. While the letter E in the scroll region does not change position in the bit map memory, the illusion is created when the bit map memory is displayed (starting from Yoffset) that the letter E is moving downward. For instance, notice that the bottom stroke of the letter E, which can be seen lying in address 11 in FIG. 2B, is also lying in address 11 in FIG. 2D.

During the second vertical scan the system starts reading the display region at address 14, which has become Yoffset. Because Ylimit is 15 the system continues reading from address 0 as the next address to be read after reading row 14. In effect the reading of the rows is wrapped around from row 14 to row 0. During this second vertical scan, the screen is refreshed to display (as shown in FIG. 2C) the bit map memory, but at the same time the bit map memory is altered to the arrangement shown in FIG. 2F. Note that in FIG. 2F, the Ws are now in address 13, the Xs are in address 14, the Ys are in the address 0 and row 12 has become the spare row. It should also be noted that during the second vertical scan the address 13 has become the Yoffset and that filler material has been added to address 2. Accordingly the letter E disappears downward and the filler material appears to advance thereafter. The circuitry for accomplishing the upward and downward scroll is shown in FIG. 3.

Before discussing the circuitry to accomplish the foregoing operations, let us consider what transpires in a horizontal scroll mode. In a horizontal scroll mode, for instance, in the operation where the scroll is from right to left, the information would be shifted one or more pixel positions by a barrel shifter as it is loaded into either of the two output registers.

The data path chip includes two output registers because in a left hand scroll when a word (128 bit word in a preferred embodiment) is shifted, the word loses bits on the left hand side and acquires momentarily empty pixel positions on the right hand side. Accordingly the information cannot be rewritten into the set of pixel positions in memory whereat the information formerly resided. The second register is needed to accept the next 128 bit word and shift it whereby the empty pixel positions in the first word become filled and then a 128 bit word can be rewritten into memory at the former position of the first word. In the second step, of course, there will be empty pixel positions at the right hand end and those positions will be filled by accepting and shifting a third word. Each of the succeeding rows as they were advanced into the barrel shifter would be shifted in the same way. Accordingly the column 19 of pixels (FIG. 1B) would be advanced, during the first vertical scan, to the left-most position of the region and hence the dots in the column 15 would have disappeared. At the same time filler material would be added to the column 21. This alteration is made in the bit map memory per se so that during a subsequent vertical scan (when the screen is refreshed with a sequential addressing operation), the letter E would appear to have been moved to the left and in succeeding vertical scan times the letter E would disappear in its movement to the left. Eventually the background or filler material would completely advance to the left across the scroll region. It should be apparent that scrolling from left to right would be a similar operation with the barrel shifter merely shifting the information in the opposite direction.

Figure 3:
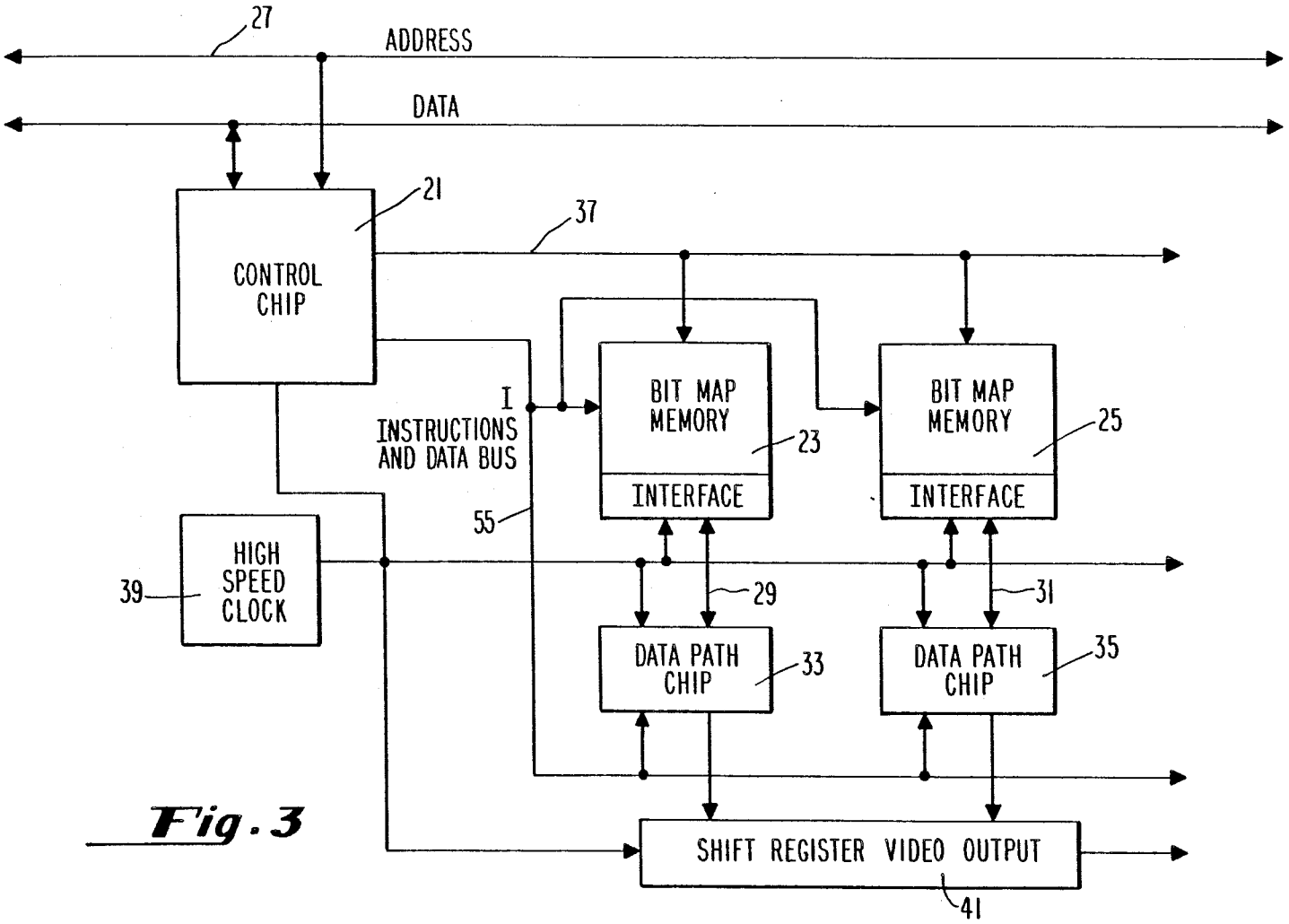
FIG. 3 is a block diagram of the present system.

The overall circuitry of the system is shown in FIG. 3. A control chip 21 is connected to the two sections of the bit map memory 23 and 25. The bit map memory is shown in two sections because each section represents a plane of memory. If the system is going to provide colors or shades of colors, then, of course, many planes would be used. In the preferred embodiment the bit map memory is a static column dynamic RAM Part No. MB 8281-12 obtained from the FUJITSU Company. In accordance with well known techniques, the sequential addressing of the bit map memory is arranged so that every row of the bit map memory is addressed at least every 2 milliseconds. The control chip 21 receives command signals from a CPU via the command bus 27. These command signals are executed on the bit map memories. The CPU is programmed to make the decisions as to what will be shown on the display and therefore what addresses to choose in the bit map memory.

The information signals from the bit map memories 23 and 25 are transmitted along the bidirectional channels 29 and 31 to the data signal path chips, respectively chip 33 and chip 35. As indicated earlier, the data signal path chips each include two output registers, one FIFO register and one barrel shifter. Depending on what is to be accomplished, the information is transmitted through the FIFO register, through the barrel shifter and into the two output registers. During refresh cycles, with or without scrolling, information signals are transferred from the bit map memory (in accordance with instruction signals on bus 55 and as addressed by command signals on line 37) into the input FIFO and simultaneously therewith into the video output shift register 41. Information in the register 41 is shifted therefrom to be displayed on the video screen. If scrolling is required, then during a subsequent scroll cycle, the information signals are transmitted from the data path chips through the channels 29 and 31 back to the bit map memory at locations selected by the bit map address signals coming from channel 37 and in response to instructions on bus 55. The address signals transmitted on channel 37 for refresh and rewrite (scroll) are generated in the control chip 21.

A high-speed clock 39 provides timing signals: to shift the video signals out of the video shift register 41; to activate the data signal path chips 33 and 35; to clock the control chip 21; and to control the bit map memory devices 23 and 25. As part of those timing signals, the timing circuitry 39 provides sync signals to the control chip 21 and the data path chips 33 and 35 so that the data signals processed thereby are synchronized with the operation of the remainder of the circuitry within the system. The generation of such timing signals is so well understood that no further detailed description is deemed necessary.

Figure 4:
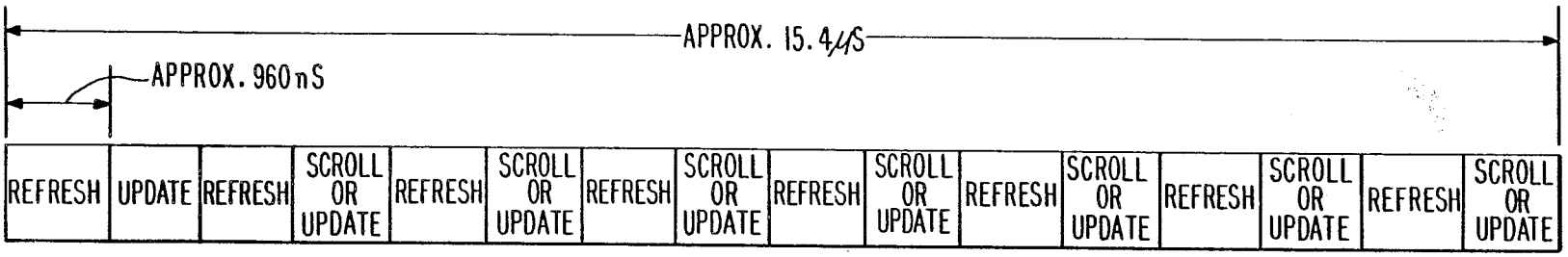
FIG. 4 is a timing diagram for a single horizontal scan.

As shown in FIG. 4, the timing signal circuit 39 provides a plurality of signal cycles during each horizontal scan. Within those cycles the system is able to alternately effect refreshing of the screen and (i.e. during the cycles between refresh cycles) either updating or scrolling depending upon which activity is selected.

FIG. 4 depicts the memory cycles during one horizontal scan which is approximately 15.4 microseconds in the preferred embodiment. Note that in FIG. 4 there is a refresh cycle (approximately 960 nanoseconds) followed by an update cycle. During the update cycle the system may add new data to the bit map memory. The update cycle, in the example shown, is followed by a refresh cycle and the refresh cycle is further followed by a scroll or an update cycle, etc. By reading out bursts of 128 bits and writing in bursts of 128 bits, the system manages to completely rewrite the bit map memory within one vertical scan time. The features of the system which enable the bit map memory to be completely read within one vertical scan time, and which enable all the changes which are necessary to accomplish scrolling, or the like, to be made within that vertical scan time, thus enabling the system to use the normal sequential addressing of the memory to effect a display, and enabling the viewer to never see the same display from one vertical scan to another, make the present system unique.

Two other parameters are employed in the present system, namely Ymin and Ymax. The Ymin is Y address whereat the scroll region begins and Ymax is one address higher than the address whereat the scroll region finishes. The values Ymin and Ymax are used in the logic shown in the FIG. 5.

Figure 5:
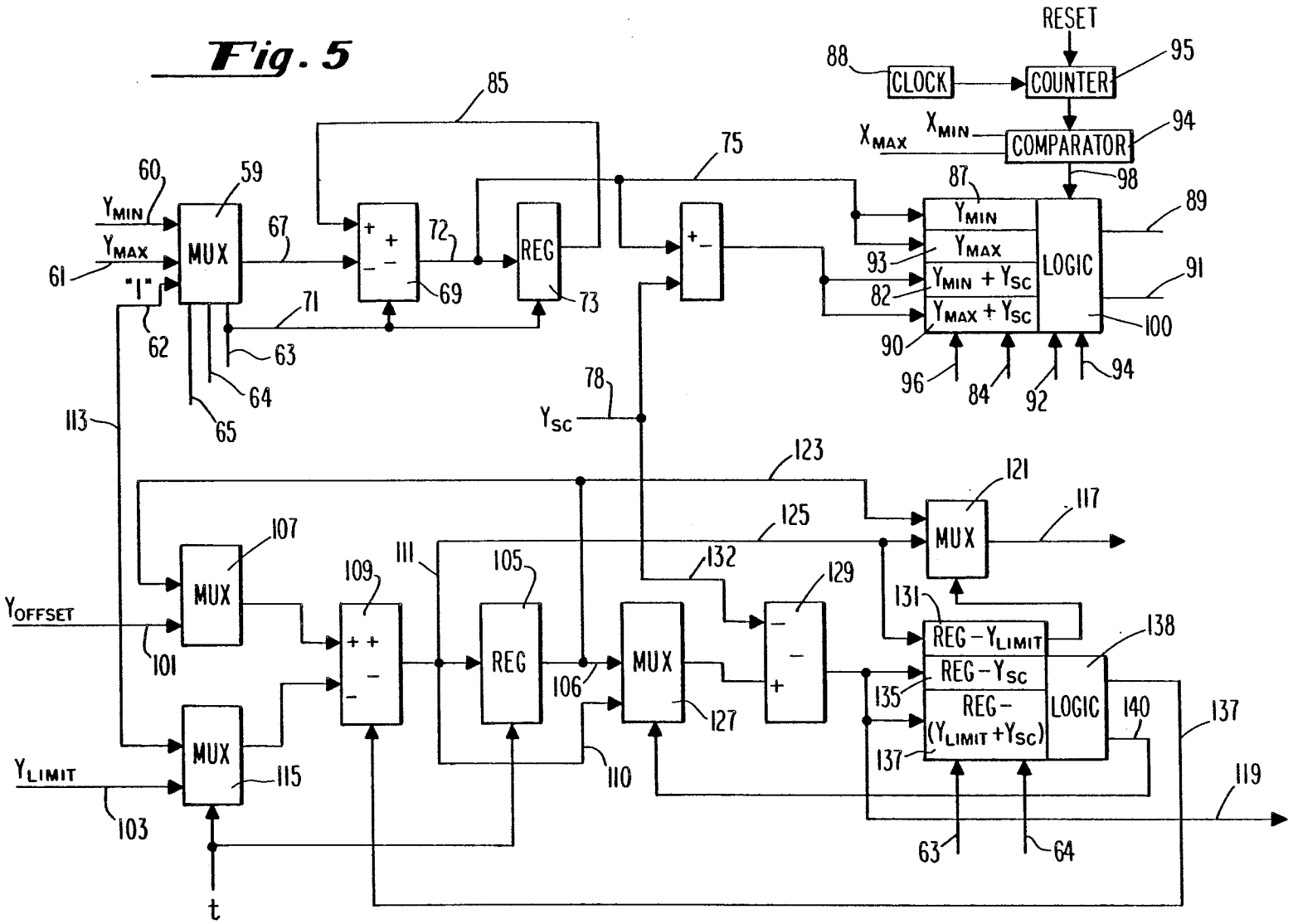
FIG. 5 is a detailed block diagram of the control chip.

Before studying the circuitry of FIG. 5, let us consider what decisions the circuitry must make to accomplish the procedure described above. During a vertical upward scroll, the system must copy what is in the second row of the scroll region and rewrite it into the preceding row address within the scroll region. For instance, in FIG. 1B, the upper bar of the letter E is in address 5, which is the second row of the scroll FIG. 1D region. The upper bar is copied and written into address 4. The system also must to copy each row in the scroll region after the second row and write each such subsequent row into the preceding row address within the scroll region. In addition, the system must not copy the portion of the Ymax row which lies within the X coordinates but rather must write filler material into the last row of the scroll region. For instance, in our example, the system will not copy the Ls, but will add filler in address 12 during the first vertical scan. Accordingly at the time that the beam is at Ymin+Ysc, the system wants to take the information (copy) from address 5 in the bit map memory and write such information into address 4. Also accordingly, when the video beam is at Ymax, the system does not want to copy the Ls but does want to provide filler information to address 12 in the region. Lastly, when the scan is at Ymax+Ysc the system wants to stop writing completely. The upper half of the circuitry of FIG. 5 makes the decisions on whether to copy and whether to rewrite depending upon the position of the beam, the values of Ymin and Ymax and the operation in effect, i.e., upward or downward scrolling.

FIG. 5 shows the logic of control chip 21. Three signals Ymin, Ymax and a signal representing the value "1" are input to a multiplexer (MUX) 59 respectively on lines 60, 61 and 62. The signals Ymin and Ymax are transmitted from the CPU to the MUX 59, while the "1"s come from a ROM on the control chip. The foregoing signals are permitted to be respectively transmitted through MUX 59 in response to timing signals on lines 63, 64 and 65. If the line 63 is energized, then the "1" signal on line 62 is transmitted through MUX 59 to the lines 67. If the timing signal of line 64 is present, then the Ymin signals on lines 60 are transmitted through MUX 59 to lines 67. Finally if the timing signal on line 65 is present, then the Ymax signals on line 61 are transmitted through MUX 59 to the lines 67. The signal on line 63 also serves as an add/subtract signal to the add-subtract device 69. In the preferred embodiment the add-subtract device 69 is similar to a 74181 manufactured by Texas Instruments Co. A "1" on line 71 causes the add-subtract device 69 to add while a "0" on line 71 causes the add-subtract device 69 to subtract. The register 73 receives the output of the add-subtract device 69 on line 72 provided, of course, that register 73 is enabled by a "1" on line 71. During each horizontal scan a "1" is added to the number in register 73. The "1" is added to current sum in the register 73 in the add-subtract device 69. The sum in register 73 represents the vertical beam position on the screen.

The purpose of the circuitry in the upper half of FIG. 5 is to provide two signals respectively on lines 89 and 91. During an upward scroll those two signals will respectively inform the system: when to start copying information from the memory into the output registers on the associated data path chip (or chips); when to stop copying information from the memory and start copying fill data into the output registers on the associated data path chip (or chips); when to start writing information into the memory from the output registers on an associated data path chip; and when to stop writing information into the memory. The manner in which this is accomplished is to keep an account of the beam position when the beam position is in the scroll region the system will be cognizant thereof.

As can be seen in FIG. 5, the system includes a counter 95 which is reset to zero at the beginning of each horizontal scan. The counter 95 is incremented by clock signals from clock 88. Which operates at the same speed with which pixels are presented during the horizontal scan. Accordingly the value in the counter 95 represents the X position of the scanning beam. Connected to the counter 95 is a signal comparator 94. The values of Xmin (which is the lefthand column of the scroll region) and Xmax (which is one column beyond the righthand column of the scroll region) are transmitted from the CPU and stored in the signal comparator 94. When the counter 95 reaches the value of Xmin, the comparator 94 sets a flip flop, or some other form of latch, which provides a continuing signal indicating that the X position of the beam is "in" the scroll region. When the counter 95 reaches Xmax, the flip flop is reset and the system knows that the X position of the beam is "out" of the scroll region. The signal on line 98 indicates whether the beam is inside or outside the scroll region.

which are connected together to effect the conditions shown in Table I. As comprises well understood in the data processing art, the gates of logic circuitry 100 can be connected together in a variety of ways to satisfy the conditions of Table I. In order to simplify the description, Table I is set out to describe logic circuit 100. The CPU knows whether the system is doing an upscroll, a downscroll or an erase of the scroll region and the proper operation signals on lines 92 and 94 are transmitted to the logic circuitry 100. Table I shows that during an upscroll operation there are six conditions in the scroll mode. In conditions 1 through 5, the signal on line 98 indicates that the X position of the beam is in the scroll region. In condition 1 the logic determines that the Y position of the beam has not reached Ymin and therefore the logic indicates there is no reason to copy or rewrite data from the scroll region. Because the system deals with both upscrolling and downscrolling, the system copies filler information if the logic indicates no need to copy. Hence for condition 1, pin 89 indicates filler information should be copied but pin 91 indicates that the filled information should not be rewritten. In condition 2, the logic circuitry 100 determines that the Y position of the beam is equal to (0) or greater than (P) Ymin. Accordingly the logic provides a signal on pin 89 which indicates that data should be copied. However, if we look at FIGS. 1D and 1B we see that we do not want to write the dots from address 4 (FIG. 1B) into address 3 of memory as shown in FIG. 1D. Hence pin 91 in condition 2 of Table I indicates that whatever may have been copied should not be rewritten. In condition 3 the logic circuitry 100 determines that the Y position of the beam is either equal to (0) or greater than (P) Ymin+Ysc. The signals on pins 89 and 91 respectively indicate (in condition 3) to copy data and rewrite it. If we look at FIGS. 1B and 1D we see that in address 5 of FIG. 1B the upper bar of the letter E resides. Examining FIG. 1D, we see that the upper bar of the letter E has been copied and rewritten into address 4 of the mem-

TABLE I

| Condition | Pin 98 | Pin 92 | Pin 94 | Latch Ymin 87 | Latch Ymin + Ysc 82 | Latch Ymax 93 | Latch Ymax + Ysc 90 | Pin 89 | Pin 91 |
|---|---|---|---|---|---|---|---|---|---|
| 1 | I | DC | UP | N | N | N | N | F | NWR |
| 2 | I | S | UP | P/Ø | N | N | N | D | NWR |
| 2A | I | E | UP | P/Ø | N | N | N | F | NWR |
| 3 | I | S | UP | P/Ø | P/Ø | N | N | D | WR |
| 3A | I | E | UP | P/Ø | P/Ø | N | N | F | WR |
| 4 | I | DC | UP | P/Ø | P/Ø | P/Ø | N | F | WR |
| 5 | I | DC | UP | P/Ø | P/Ø | P/Ø | P/Ø | F | NWR |
| 6 | O | DC | UP | DC | DC | DC | DC | DC | NWR |
| 7 | I | S | DN | N | N | N | N | D | WR |
| 8 | I | S | DN | P/Ø | N | N | N | F | WR |
| 9 | I | S | DN | P/Ø | P/Ø | N | N | F | NWR |
| 10 | I | S | DN | P/Ø | P/Ø | P/Ø | N | D | WR |
| 11 | I | S | DN | P/Ø | P/Ø | P/Ø | P/Ø | D | WR |
| 12 | O | S | DN | DC | DC | DC | DC | D | WR |

I = Beam in X boundaries of scroll region
O = Beam not in X boundaries of scroll region
N = Negative
P = Positive
Ø = zero
D = Data
WR = Write
NWR = Not write
E = Erase
S = Scroll
DC = Doesn't care
F = Fill
UP = Upscroll
DN = Downscroll Table I is the truth table for the logic circuitry 100. The logic circuitry 100 in FIG. 5 is a plurality of gates ory. In view of the foregoing explanation the conditions 4 and 5 and their resultant signals on pins 89 and 91 should be apparent. In condition 6 the X position signal indicates that the beam is not in the X boundaries of the scroll region and accordingly the conditions of Ymin, Ymin+Ysc, Ymax and Ymax+Ysc are irrelevant. The data outside of the scroll region is undisturbed during an upscroll operation.

If we consider a downscrolling operation and Table I, we find six conditions, i.e., conditions 7 through 12. In downscrolling, the data outside of the scroll region is moved up in the memory and wrapped around. In condition 12 the logic determines from the X position signal that the beam is not within the X boundaries of the scroll region. If we look at FIG. 2, condition 12 means that the beam is somewhere in the first three columns or in the last three columns. Hence pins 89 and 91 (as shown in Table I) indicate to the system that the data should be copied and rewritten. In condition 7, the logic 100 determines from the negative conditions of the latches and the "in" condition of the X position signal, that the beam is within the X boundaries of the scroll region but it has not reached Ymin. In condition 7 the beam is somewhere within columns 4 through 10, and is scanning the Ws, Xs, Ys, and Zs in FIG. 2B. It follows that the system wants to copy and rewrite that data in a downscroll and pins 89 and 91 indicate that the data should be copied and rewritten. In condition 8, Table I indicates that the beam has reached Ymin but not Ymin plus Ysc, hence the beam is at address 4. Pins 89 and 91 indicate that the data should not be copied (as explained earlier, filler information will be copied) and that filler information should be rewritten. Note in FIGS. 2B and 2D that as the AAAs are rewritten from address 4 in FIG. 2B into address 3 in FIG. 2D, filler information is also rewritten into address 3 of FIG. 2D. In condition 9 the logic circuitry 100 determines that the beam is in at least the second row of the scroll region and therefore the data in the memory should not be disturbed. Pin 89 says do not copy the data in the second row (copy filler information) but pin 91 says do not rewrite whatever has been copied. The foregoing operation will continue for each horizontal scan until the beam gets to Ymax. In condition 10 the logic determines that the beam has reached Ymax (address 13 in FIG. 2) and hence the data should be copied and rewritten (the Ls should be copied and rewritten into address 12). Accordingly, pins 89 and 91 respectively tell the system to copy the data and rewrite it. Condition 11 is a continuation of the activity determined in condition 10. As stated above Table I is the truth table for logic circuitry 100.

It is often desirable that a particular region of a display be erased. The present system permits such an erase operation by writing filler information into the pixel positions of the bit map memory that define the region to be erased. The filler information signals are provided from the RAM 150 shown in FIG. 6. The present system effects the erase operation in response to the signals from the CPU on lines 92 and 94 as they are set out in conditions 2A and 3A of Table I. Note that conditions 2A and 3A result in pin 89 directing that filler information signals should be copied at all times and therefore, when the system is in the erase mode, filler information signals are written into all position of the region.

The scroll latches 87 and 93 are respectively identified as Ymin and Ymax in FIG. 5. The Ymin value on line 60 came originally from a CPU and is transmitted through the MUX 59 to the add-subtract device 69 whereat it is subtracted from the sum in the register 73. Bear in mind that the position of the beam is advancing vertically, that is through the beam positions 0, 1, 2, etc. In the example shown in FIG. 2, Ymin is at position 4 and hence when the value of register 73 is equal to 4, the result of the subtraction, as provided by a signal on line 72, will be "0". A "0" signal is recognized as a positive signal. Hence a positive signal is transmitted to both the Ymin scroll latch 87 and the Ymax scroll latch 93. However, the Ymin signals on lines 60 were transmitted through MUX 59 in response to the clock signal on line 64 and the same clock signal is present on line 96 to enable only the Ymin scroll latch 87 to be receptive. Accordingly, the positive value is transmitted from the add-subtract device 69 along line 75 to the Ymin scroll latch 87 and stored therein. As can be seen from Table I, a positive sign signal in latch 87 is one of the requirements for condition 2. When the beam position reaches the same value as Ymin, on line 60, a zero signal is obtained from the add-subtract device 69 on line 72. The zero signal is transmitted to the subtractor 76, whereat it is subtracted from Ysc. The Ysc is transmitted from a register on line 78 to the subtractor 76. As was mentioned above, the example shown in FIGS. 1 and 2 assumes that Ysc=1, but in fact Ysc could be some other number. In any event, we will assume throughout this description that Ysc=1. In subtractor 76 Ysc is subtracted from the output of add-subtract device 69. In our example, the difference is −1 and the negative sign signal is stored in latch 82. If the beam has not reached Ymin+Ysc, then it has not reached Ymax and hence latches 93 and 90 will both be negative. From Table I we can see that if latch 87 is positive and the other latches are negative, then we are in condition 2. When the beam position is at Ymin+1 then a "1" is entered into the subtractor 76 and the output is a zero. When the subtraction of the Ysc provides an "0", or a plus signal, from the subtractor 76, there is a positive signal stored in the "Ymin+Ysc" latch 82. Accordingly, we get to condition 3 of Table I. If we examine FIGS. 1B and 1D, we find that information in address 5 within the region is indeed copied and rewritten into address 4 in response to the signals on lines 89 and 91. The address 4 is supplied by the signals on line 37. The system tests the position of the beam during each horizontal scan against the values of Ymin, Ymax, Ymin+Ysc, and Ymax+Ysc and logic 100 provides the proper signals on pins 89 and 91.

When the beam position from the register 73 reaches Ymax, i.e. position 13, then the Ymax value on line 61 will be subtracted (in subtractor 69) from the sum in register 73 as transmitted on line 85. At that time there would be an output of "0" on line 72, which is transmitted to the Ymax scroll latch 93. The Ymax scroll latch 93 will accept that "0" value, or positive value, because the clock signal on line 84 conditions scroll latch 93. As can be determined from Table I, the positive signal in Ymax latch 93 is a requirement for condition 4. The "0" value signal on line 72 is also transmitted to the subtractor 76 whereat it is subtracted from "1" to provide a negative value signal on line 86 which is forwarded to the Ymax+Ysc latch 90. A negative value signal in latch 90 is also a requirement of condition 4 in Table I. It follows that pins 89 and 91 tell the system to copy filler information and write it. It can be seen from FIG. 1 that the Ls which are at Ymax and within the X boundaries are not copied to be rewritten within the scroll region, but instead filler information is rewritten into address 12 in FIG. 1D. The foregoing operation is what the signals on lines 89 and 91 directed. When the beam position exceeds Ymax by 1, during the next horizontal scan, there will be a value of "1" input to the subtractor 76 and when the Ysc is subtracted therefrom there will be a "0" on line 86. The "0" signal on line 86 will be received and stored by the Ymax+Ysc latch 90 in response to the clock signal on line 84. The storing of the positive value in the scroll latch 90 along with the other sign signals discussed will provide condition 5 of Table I, which indicates to the system that writing, or rewriting, should be stopped.

The foregoing discussion dealt with the test operation of the circuitry in the upper half of FIG. 5, but in particular described the utility of the signals on lines 89 and 91 with respect to an upward scroll. When the system operates in a downward scroll (as discussed in connection with FIG. 2) the tests involving Ymin, Ymax and Ysc are identical to those described above but the utility of the signals on lines 89 and 91 is different. In a downward scroll the system is copying and rewriting the data which is external to the scroll region because that data is being moved upward and wrapped around as described in connection with FIG. 2. When the scan gets to the scroll region (i.e., gets to Ymin), the system needs to terminate copying data from the scroll region because it will be recalled that the data in the scroll region of the memory remains in place. However, the system does want to write in filler information. Accordingly, in condition 8 of Table I the logic 100 tells the system to "not copy" but to write fill material. If we examine FIGS. 2B and 2D, we find that when the scan gets to Ymin or address 4 (condition 8 of Table I) the dots in address 4 of FIG. 2B remain in address 4 of FIG. 2D (i.e., do not copy data). However, note that the positions in memory between AAA and AAA, when the external data is moved from address 4 of FIG. 2B to address 3 of FIG. 2D, are to be loaded with filler information, (i.e., do not copy but write filler information). One horizontal scan later (condition 9 of Table I) the signals on pins 89 and 91 tell the system to stop rewriting (i.e., do not write filler information). During each horizontal scan thereafter, so long as the scan is in the scroll region, the system will test the scan against Ymin and Ymax and as long as Ymax has not been reached, the system will not rewrite in the scroll region, so it makes no difference what is being copied. When the scan reaches Ymax (condition 10 of Table I), there will be signals on pins 89 and 91 which tell the system to start copying data and rewrite it. When the scan gets to position 13 (address 13 in memory) the system needs to copy the complete row of Ls because the Ls between the "X" boundaries of the region are going to be rewritten into address 12 (FIG. 2D), including the lowest row of the scroll region as defined in FIG. 2B. Continuing with the study of FIG. 5 and downscrolling, when the scan advances one horizontal scan and gets to position Ymax+Ysc (condition 11 of Table I), there are no new actions required and so this boundary is not used during downscrolling.

Because the system does a wrap around during down scrolling, the system must continually test the scan position against Yoffset and Ylimit to determine the refresh addresses and the scroll addresses to be used in order to enable the display device to depict an image which can be unlike its format in the bit map memory. The lower half of the circuitry in FIG. 5 is employed in the control chip to perform the tests and generate the addresses.

Table II provides the relationships between the value REG of the register 105, Ysc and Ylimit, which the lower circuitry of FIG. 5 must accommodate to provide the refresh address and the scroll address $A_s$. The refresh address is the address in memory from where the data is read in order to refresh the video screen. The scroll address is the address in memory to which data or filler information is transmitted during a scroll period or an update period.

TABLE II

| Latch 131 | | Condition | |
|---|---|---|---|
| N | | 1 | If Reg. <Ylimit, then $A_r$ = REG |
| P | | 2 | If Reg. <Ylimit, then $A_r$ = REG − Ylimit |
| **Latch 135** | **Latch 137** | **Condition** | |
| P | N | 3 | If Reg. Ysc ≧ 0 and < Ylimit, then $A_s$ = REG − Ysc + Ylimit |
| N | N | 4 | If Reg. Ysc < 0 then $A_s$ = REG − Ysc + Ylimit |
| P | P | 5 | If Reg. −Ysc ≧ Ylimit, then $A_s$ = REG − Ysc Ylimit |

When the system commences a vertical scan, a value for Yoffset is transmitted from the CPU on line 101 through the MUX 107, through the add-subtract device 109 to the register 105. During each horizontal scan, the value of "1" is transmitted from the CPU, on line 113, through MUX 115 to the add-subtract device 109. In the add-subtract device 109, the value REG of the address register 105 is added to the value of "1" and hence the value REG of the register is continually increased with each horizontal scan.

The lower portion of the circuitry of FIG. 5 determines the refresh address $A_r$. There are two test periods in which this circuitry operates. These two tests take place during each horizontal scan. During the first test period, when the vertical scan commences, the value of Yoffset is entered into register 105. At the time that the Yoffset value is loaded into the register 105, it is also passed through MUX 127, into the subtractor 129. In the subtractor 129 the value Ysc, from line 132, is subtracted from the Yoffset value and the sign signal is transmitted to the "REG-Ysc" latch 135. That sign signal is employed in determining the scroll address $A_s$. This operation constitutes the first test period.

The Yoffset transmitted at the commencement of the first vertical scan is subtracted from the Ylimit value during the second test operation, and the sign value by add-subtract device 109 is transmitted from the add-subtract device 109 to the "REG-Ylimit" latch 131. If the sign is negative, then the value signals from the register 105, as transmitted on line 123, are passed through MUX 121 and these signals which represent the refresh address $A_r$ appear on lines 117. Also in the second test period, the value of "REG-Ylimit" is transmitted through MUX 127 to the subtractor 129. In the subtractor the value Ysc is subtracted from the value (REG-Ylimit) and the sign signal is transmitted and stored in the "Reg-(Ylimit+Ysc)" latch 137.

In response to the sign signal stored in latches 135 and 137, the logic circuitry 138 provides signals on lines 137 and 140. If we examine Table II we find that if latch 131 is negative, then the value REG is the refresh address $A_r$ and if latch 131 is positive (or has a value of zero, which is considered positive), then the value from the add-subtract device 109 is the refresh address. Further, if latch 135 is positive (or zero) and latch 137 is negative, then the scroll address $A_s$ will be the value (condition 3) REG-Ysc. If latch 135 and latch 137 are both negative (condition 4), then the scroll address $A_s$ will be REG-Ysc+Ylimit. If latch 135 and latch 137 are both positive (condition 5), then the scroll address $A_s$ will be REG-Ysc−Ylimit.

Table III shows the signals which are generated by the logic circuitry 138 in response to the sign signals in the latches 135 and 137.

TABLE III

| Condition | mux 127 passes signals on line | Add-Subtract Device 109 |
|---|---|---|
| 3 | 106 | Subtracts |
| 4 | 110 | Adds |
| 5 | 110 | Subtracts |

Both the add-subtract device 109 and the subtractor 129, in a preferred embodiment, are similar to a 74181 manufactured by Texas Instruments Co. However, both of these arithmetic devices are in chip form. The logic circuitry 138 comprises a plurality of gates which effect Tables II and III and which can take on a number of different configurations.

Let us examine FIG. 2B in conjunction with the operation of the circuitry of the lower section of FIG. 5. In FIG. 2B Yoffset is "0". When the vertical scan commences, the value of "0" is inserted into register 105 and simultaneously is subtracted from Ysc (Ysc=1) in subtractor 129. Accordingly a negative sign signal is transmitted to the latch 135. In the second test, the value of "0" is brought from the register 105 by a timing signal on line 106, through MUX 107 to the add-subtract device 109. At the same time the Ylimit value is brought to the add-subtract device 109. The value Ylimit from FIG. 2B is 15. In add-subtract device 109 the value of 15 is subtracted from "0" and the negative value is sent on line 111 to the latch 131 and stored therein. If we examine again Table II, we find that a negative signal in latch 131 enables MUX 121 to pass the value signals from register 105. At this time the value REG in register 105 is "0" and hence "0" becomes the refresh address $A_r$. If we examine FIGS. 2B and 2A, we find that the Ws in the zero position of the display come from the "0" address in memory.

In the second test the value of −15 was passed through MUX 127 to the subtractor 129. In subtractor 129 the Ysc value of 1 is subtracted so that the value of −16 from the subtractor 129 provides a negative signal to latch 137. Hence there are two negative signals provided to the logic circuitry 138. If we go to Table II we find that two negative signals creates condition 4, which condition causes add-subtract device 109 to add and causes MUX 127 to pass the results from add-subtract device 109. Accordingly the value REG of register 105 equal to "0" is added to the Ylimit value of 15. Signals representing a value of 15 are transmitted through MUX 127 to the subtractor 129 whereat the value of 1 (Ysc) is subtracted from 15 to provide signals on lines 119 which are equal to 14. Hence the scroll address $A_s$ equals 14. If we examine FIG. 2D we find that the Ws have been rewritten into address 14.

Consider a second vertical scan wherein the memory is configured as in FIG. 2D. Initially the value of 14 (Yoffset) is loaded in register 105, as described above. At the same time the value of 14 is transmitted to the subtractor 129 from whence the value of 1 (Ysc) is subtracted, leaving a difference of +13. The positive signal is transmitted to the latch 135 and stored thereat. During the second test, the value of 14 from register 105 is subtracted from Ylimit and the value −1 is the difference signal transmitted from the add-subtract device 109. The negative signal is transmitted to latch 131 while the value of −1 is transmitted to the subtractor 129. In the subtractor 129 the value of 1 (Ysc) is subtracted from −1 and there results a value of −2. Accordingly, a negative value signal is sent to latch 137. If we examine Table II we find that a negative value REG in latch 131 will pass the value of register 105 to lines 117. Accordingly the refresh address $A_r$ is 14. Also from Table II we find that if latch 135 is positive and latch 137 is negative, we have condition 3. If we go to Table II we find that with condition 3, the add-subtract device 109 subtracts and MUX 127 passes the signals on lines 106. Since the signals on lines 106 are going to be passed through MUX 127, it does not matter what add-subtract device 109 does. The signals on lines 106 represent the value REG 14 from register 105 and the value of 14 is transmitted to the subtractor 129. In subtractor 129 the Ysc or "1" is subtracted from the value of 14, leaving a value of 13. The signals representing 13 are transmitted on lines 119 as the scroll address $A_s$. If we examine FIG. 2F, which is the configuring of the memory during the second vertical scan, we find that the Ws have been rewritten into address 13. We also find in FIG. 2C that the zero position of the display has been refreshed from address 14 in memory, which is the value on lines 117.

We have dealt with conditions 1, 3 and 4 from Table II. As for condition 2, let us consider that the scan of the memory has gone to address 16 of FIG. 2D. Bear in mind that we have advanced two horizontal scans and therefore register 105 reads 16. During the first test the value of 16 will be passed through MUX 107 to the add-subtract device 109, therefrom through MUX 127 to the subtractor 129. In subtractor 129 the value of 16 is reduced by 1 to provide a positive sign to latch 135. During the second test Ylimit is transmitted to the add-subtract device and hence the value 15 is subtracted from 16 to provide +1 therefrom. The positive sign is transmitted to latch 131. If we examine Table II we find that a positive signal in latch 131 is condition 2 and the system provides an output REG-Ylimit from add-subtract device 109. In the example under consideration the output signal is +1 and hence the refresh address $A_r$ is 1 in FIG. 2D. Bear in mind that at address 16 we have had two scans from Yoffset and so we are seeking the refresh address for the second horizontal scan from Yoffset as displayed in FIG. 2C. The Ys appear in that second position. The Ys are refreshed from memory address 1 in FIG. 2D and that is the refresh address on lines 117 in our present example.

The +1 from add-subtract device 109 described above, during the second test, is transmitted to the subtractor 129. The Ysc value of 1 is subtracted from 1 and hence a "0" value or a plus sign signal is transmitted to latch 137. If we examine Table II we find that positive signals in latches 135 and 137 is condition 5, which condition causes add-subtract device 109 to subtract and MUX 127 to pass the output from the add-subtract device 109. In this condition when the Ylimit is subtracted from register 105, a +1 is provided from add-subtract device 109. The +1 is transmitted to the subtractor 129 whereat the Ysc value of 1 is subtracted to give a value of "0" on lines 119. Hence the scroll address $A_s$ is "0". If we examine FIG. 2F, which represents how the memory is configured during the second vertical scan, we find that the Ys are rewritten into the 0 address of memory in accordance with the "0" scroll address on lines 119.

Figure 6:
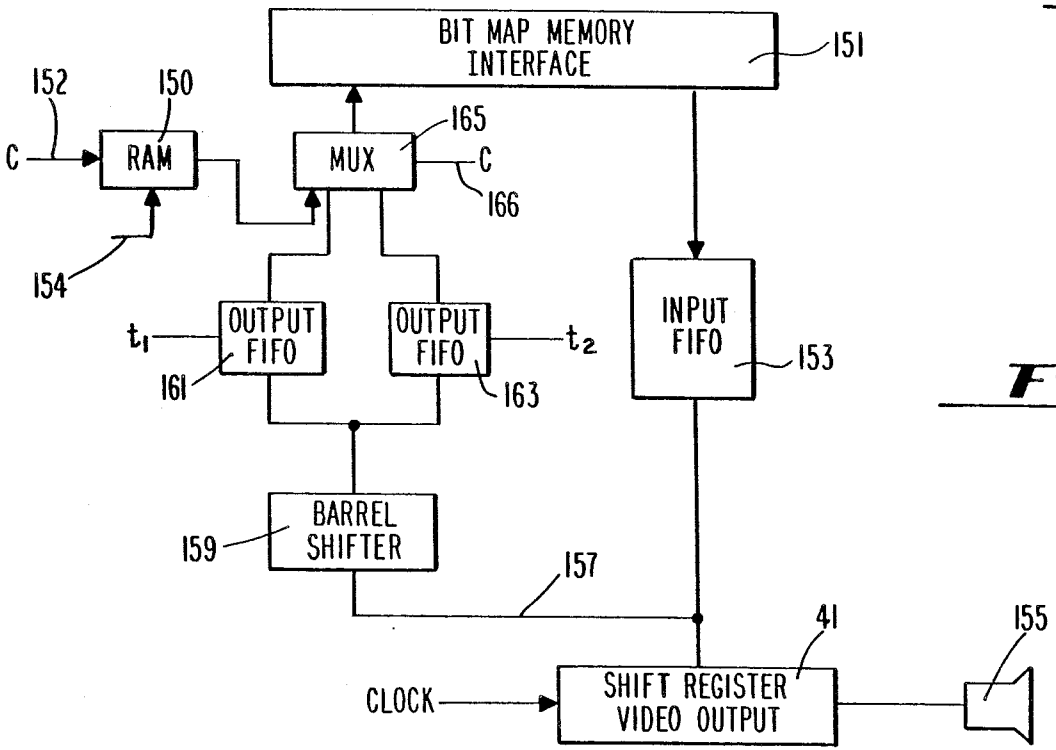
FIG. 6 is a detailed block diagram of a data path chip.

Consider now FIG. 6, which depicts the circuitry on a data path chip which is used to route signals from memory to the video display during the refresh cycles and from memory selectively back into memory. Signals are output from the bit map memory interface 151, into the input FIFO 153, and then to the shift register 41. The signals are shifted out of the shift register 41 to be displayed by the display device 155. The display device 155 is not located on the data path chips but is shown in FIG. 6 to depict the utility. In addition to being transferred to register 41, signals from memory are transmitted on line 157 to the barrel shifter 159. If the system is not in a horizontal scroll mode, then the signals pass through the barrel shifter 159 without being shifted. The signals leaving the barrel shifter 159 are transmitted to the two output FIFOs 161 and 163. The signals are received alternately into the FIFOs 161 and 163 in response to the timing signals $t_1$ and $t_2$. The signals are transmitted from the output FIFOs 161 and 163 to the MUX 165. A third input channel to the MUX 165 is from RAM 150. The RAM 150 provides the filler information signals when filler information is required. The filler information signals are provided in response to a control signal on line 152 which comes from the instruction bus 55. The MUX 165 is controlled by the control signals on line 166, which control signals also come from the instruction bus 55. Each time signals are read from memory, they are loaded into the output FIFOs. However, the signals are only read therefrom if the system is rewriting those signals into memory at new addresses. If new information is to be added during an update, the new information is transmitted to the RAM 150 over channel 154. Accordingly the data path chip acts to control the data flow into the memory, but the control chip provides the address information and the instructions related to rewriting the information signals into memory.

The present system provides a unique technique for scrolling, wrapping around and erasing and a unique arrangement of hardware to accomplish the foregoing.

We claim:

1. A circuit arrangement for displaying a first set of pixel information in a scrolling region of a video display device and a second set of pixel information outside of and adjacent to the scrolling region of the video display device, said circuit arrangement comprising a bit map memory having a plurality of information storage elements arranged in an array of rows and columns, including a first group of storage elements arranged in an array of rows and columns for storing the first set of pixel information prior to display in an upward scrolling mode and a second group of storage elements arranged in rows and columns of the plurality of storage elements not included in the first group for storing the second set of pixel information prior to display in said upward scrolling mode, wherein the circuit arrangement further comprises control means connected to send address signals for sequential addressing and control signals to the bit map memory, a data path circuit connected to receive control signals on first and second control terminals from the control means and connected to send pixel information signals to and receive pixel information signals from the bit map memory, and a shift register connected to receive pixel information signals from the data path circuit and connected to send said pixel information signals to the video display device, the control means being capable of outputting first and second control signals to the first control terminal of said data path circuit and third and fourth control signals to the second control terminal of the data path circuit in dependence on the address of the storage element of the bit map memory from which pixel information is being output to the video display device, the first control signal output by the control means controlling the data path circuit to copy the pixel information output from the bit map memory to a first storage means incorporated in the data path circuit and the second control signal output by the control means controlling the data path circuit to copy pixel information from a second storage means incorporated in the data path circuit to the first storage means, and the third control signal output by the control means controlling the data path circuit to write the copied information into the bit map memory, and the fourth control signal output by the control means controlling the data path circuit to not write the copied information into the bit map memory, wherein to effect upward scrolling of the pixel information displayed in the scrolling region of the video display device during successive first and second vertical scans, the control means outputs first and third control signals which cause the data path circuit to copy that pixel information read from the bit map memory during the first vertical scan which is to be upwardly scrolled in the second vertical scan and to write this copied pixel information before the second vertical scan into bit map memory addresses which are different than the addresses at which the copied pixel information was stored before the first vertical scan, and wherein to effect downward scrolling of the pixel information displayed in the scrolling region of the video display device during successive first and second vertical scans, the control means outputs first and third control signals which cause the data path circuit to copy that pixel information read from the bit map memory during the first vertical scan which is to be unchanged in the second vertical scan and to write this copied pixel information before the second vertical scan into bit map memory addresses which are different than the addresses at which the copied pixel information was stored before the first vertical scan.

2. The circuit arrangement of claim 1, wherein to effect upward scrolling, the control means outputs address signals to the bit map memory which enable pixel information output to the video display device and copied by the data path circuit from each row of the first group of storage elements other than the top row to be respectively rewritten into the next higher row of the first group of storage elements.

3. The circuit arrangement of claim 2, wherein to effect downward scrolling, the control means outputs address signals to the bit map memory which enable pixel information generated by the data path circuit and written into the bit map memory to be written into those storage elements of the second group which are directly above the storage elements of the top row of the first group of storage elements.

4. The circuit arrangement of claim 1, wherein to effect downward scrolling, the control means outputs address signals to the bit map memory which enable pixel information output to the video display device and copied by the data path circuit from each row of the second group of storage elements other than the top row to be respectively rewritten into the next higher row of the bit map memory.

5. The circuit arrangement of claim 4, wherein the bit map memory has a spare row of storage elements with no pixel information stored thereat.

6. The circuit arrangement of claim 5, wherein to effect downward scrolling, the control means is further capable of outputting address signals to the bit map memory such that pixel information output to the video display device and copied by the data path circuit from the top of the second group of storage elements is rewritten into the lowest row of the second group of storage elements.

7. The circuit arrangement of claim 5, wherein the control means comprises a multiplexer into which three signals are input corresponding respectively to the number of the first row of the first group of storage elements in the bit map memory, the number of the next row after the last row of the first group of storage elements, and the value of unity, an add-subtract device having a first terminal connected to receive the output of the add-subtract device and to output the register contents to a second terminal of the add-subtract device, the register contents representing the vertical position of an electron beam on the screen of the video display device, the multiplexer, add-subtract device and register being further connected to the timing circuit for receiving and responding to timing signals such that a value of unity is added to the register contents by the add-subtract device during each horizontal scan peformed by the electron beam of the video display device.

8. The circuit arrangement of claim 7, wherein the control means further comprises a counter which counts at the rate with which pixels are horizontally scanned by the electron beam of the video display device, the value stored in the counter representing the horizontal position of the electron beam on the screen, and a comparator connected to receive the output of the counter and having the numbers of the first and last columns of the first group of storage elements stored therein, the comparator being capable of outputting a signal to indicate that the electron beam position corresponds to one of the columns which includes storage elements of the first group.

9. The circuit arrangement of claim 8, wherein the control means further comprises a logic circuit capable of outputting the first through fourth control signals of the control circuit in dependence on control signals from a central processing unit and on the electron beam position as indicated by the row and column of the bit memory being read.

10. The circuit arrangement of claim 9, wherein the control means further comprises a generator for generating a signal representing the number of rows by which a scrolled display is displaced during a scrolling increment, and a subtraction circuit connected to subtract the value of the scrolling increment from the output of the add-subtract device.

11. The circuit arrangement of claim 1, wherein to effect upward scrolling, the control means outputs address signals to the bit map memory which enable pixel information generated by the data path circuit and written into the bit map memory to be written into the bottom row of the first group of storage elements.

12. The circuit arrangement of claim 1, wherein the bit map memory has an interface associated therewith, and the data path circuit comprises an input register connected to receive pixel information signals from the bit map memory interface and connected to output pixel information signals to the shift register, a barrel shifter connected to receive pixel information signals from the input register, said first storage means comprising first and second output registers connected to alternatingly receive the shifted pixel information from the barrel shifter, said second storage means comprising a random access memory capable of outputting pixel information in dependence on whether the first or second control signal is output by the control means, and a multiplexer connected to receive pixel information signals from the first and second output registers and pixel information signals from the random access memory and connected to output signals to the bit map memory interface, the multiplexer being capable of outputting the pixel information signals from the output registers or from the random access memory to the bit map memory interface in dependence on whether the third or fourth control signal is output by the control means.

13. The circuit arrangement of claim 1, wherein the control means is capable of outputting a refresh address signal to the bit map memory during a refresh cycle, in response to which the bit map memory outputs signals representing the pixel information stored thereat to the video display device.

14. The circuit arrangement of claim 1, wherein the video display device is capable of producing an electron beam that moves along a row of pixels during a horizontal scan, each row of pixels being scanned during a single vertical scan, the control means being capable of controlling the data path circuit such that the plurality of storage elements are rewritten during a single vertical scan.

15. The circuit arrangement of claim 14, wherein the control means comprises a register capable of storing the refresh address, which refresh address indicates the location in the bit map memory from which the stored pixel information will be output to the video display device in the form of refresh signals, and further comprises a subtractor capable of forming the scrolling address, which scrolling address indicates the location in the bit map memory whereat information will be written.

16. The circuit arrangement of claim 1, wherein a timing circuit is connected to the control means, the data path circuit, the bit map memory and the shift register.

17. The circuit arrangement of claim 16, wherein the video display device is capable of producing an electron beam that moves along a row of pixels during a horizontal scan, the timing circuit is capable of outputtng clocking signals which divide each horizontal scan into a plurality of time periods which correspond to alternating refresh and scrolling cycles, and the control means is capable of outputting control signals such that the bit map memory outputs signals representing stored information during each refresh cycle and the data path circuit inputs signals repesenting information to be written during each scrolling cycle.

* * * * *